US007571568B2

(12) United States Patent
Ito et al.

(10) Patent No.: US 7,571,568 B2
(45) Date of Patent: Aug. 11, 2009

(54) SASH WINDOWS

(75) Inventors: Tsutomu Ito, Marietta, GA (US); Masanori Moriya, Dublin, GA (US)

(73) Assignee: YKK Corporation of America, Marietta, GA (US)

( * ) Notice: Subject to any disclaimer, the term of this patent is extended or adjusted under 35 U.S.C. 154(b) by 556 days.

(21) Appl. No.: 11/328,572

(22) Filed: Jan. 10, 2006

(65) Prior Publication Data

US 2007/0157521 A1 Jul. 12, 2007

(51) Int. Cl.
*E05D 15/22* (2006.01)

(52) U.S. Cl. ..... 49/181; 49/176; 49/185; 49/67; 49/161

(58) Field of Classification Search ..... 49/176, 49/181, 183, 184, 185, 186, 187, 61, 63, 49/67, 125, 161, 158, 160; 52/204.51, 656.5
See application file for complete search history.

(56) References Cited

U.S. PATENT DOCUMENTS

| | | | | | |
|---|---|---|---|---|---|
| 3,896,589 | A * | 7/1975 | Mitchell | 49/425 |
| 4,370,830 | A * | 2/1983 | Schaefer et al. | 49/413 |
| 4,640,078 | A * | 2/1987 | Haffer | 52/844 |
| 4,689,933 | A * | 9/1987 | Biro | 52/656.5 |
| 4,831,804 | A * | 5/1989 | Sayer | 52/475.1 |
| 4,922,656 | A * | 5/1990 | Giguere | 49/161 |
| 4,922,657 | A * | 5/1990 | Foss | 49/181 |
| 4,941,288 | A * | 7/1990 | Morton | 49/504 |
| 4,977,722 | A * | 12/1990 | Taylor | 52/204.595 |
| 5,210,976 | A * | 5/1993 | Cripps | 49/181 |
| 5,237,775 | A * | 8/1993 | Hardy | 49/181 |
| 5,566,507 | A * | 10/1996 | Schmidt et al. | 49/428 |
| 6,003,277 | A | 12/1999 | Graham et al. | |
| 6,006,478 | A * | 12/1999 | Hubner et al. | 52/204.5 |
| 6,112,463 | A * | 9/2000 | Reithmeyer et al. | 49/183 |
| 6,134,857 | A * | 10/2000 | Hope | 52/656.7 |
| 6,243,999 | B1 | 6/2001 | Silverman | |
| 6,276,092 | B1 * | 8/2001 | Neo | 49/183 |
| 6,293,049 | B1 * | 9/2001 | Shaw | 49/183 |
| 6,826,871 | B2 | 12/2004 | Morton et al. | |
| 6,860,066 | B2 * | 3/2005 | Kunz et al. | 49/181 |
| 7,246,466 | B2 * | 7/2007 | Turner | 49/504 |
| 7,415,797 | B2 * | 8/2008 | Dotson et al. | 49/185 |
| 2003/0075930 | A1 * | 4/2003 | Mak | 292/1.5 |
| 2003/0079412 | A1 * | 5/2003 | Morton et al. | 49/161 |
| 2005/0016066 | A1 * | 1/2005 | Dotson et al. | 49/183 |

* cited by examiner

*Primary Examiner*—Katherine W Mitchell
*Assistant Examiner*—Catherine A Kelly
(74) *Attorney, Agent, or Firm*—Alston & Bird LLP

(57) ABSTRACT

A sash window includes a support device disposed on a lower end portion of each sash and including a pivot shaft for pivotally supporting the sash relative to a window frame, and a latch device disposed on an upper end portion of the sash for interlocking engagement with each jamb member to lock the sash in position against pivotal movement relative to the window frame. The window frame has a holder member for holding the pivot shaft in position against movement in inward and outward directions of the sash window when the sash is in a fully closed position. A first reinforcement member is mounted in at least one sash rail, and a second reinforcement member is mounted in a portion of each jamb member adapted for engagement with the latch device in the fully closed state of the sash, so as to indirectly reinforce the jamb member portion from inside the jamb member.

26 Claims, 15 Drawing Sheets

SASH WINDOWS

BACKGROUND OF THE INVENTION

1. Field of the Invention

The present invention relates generally to sash windows, and more particularly to a single-hung or double-hung window having at least two sashes supported in vertical juxtaposition within a window frame.

2. Description of Related Art

Sash windows adapted to be mounted in an opening in the exterior wall of a commercial or residential building are known as single- or double-hung windows having a pair of upper and lower sashes. Among these windows, an improvement has been proposed which comprises a sash pivotable in an inward direction (room interior side) for enabling access for cleaning to an outside surface of the sash from the room interior side (U.S. Pat. No. 6,826,871 B2).

The sash described in U.S. Pat. No. 6,826,871 B2 is sidable in a vertical direction along jamb members of a window frame between a fully closed position and a fully open position. The sash is also inwardly pivotable about pivot shafts provided at a lower end portion thereof. The sash has a support mechanism disposed on a corner portion at the bottom thereof. The support mechanism generally comprises a slide shoe slidable in a vertical direction along each jamb member while engaging the jamb member, and a pin (pivot shaft) pivotally connecting the slide shoe and the bottom corner portion of the sash. The sash further has a guide member (latch mechanism) disposed on a corner portion at the top thereof. The guide member is normally disposed in guided engagement with each jamb member so that the top corner portion of the sash is guided along the jamb member during vertical sliding movement of the sash.

The guide member also constitutes a latch mechanism so as to permit inward pivotal movement of the sash. To this end, the guide member includes a body attached to the sash, a latch bolt projecting from the body for interlocking engagement with the jamb member, and a spring for urging the latch bolt in a projecting direction. The latch bolt is connected to a knob which is disposed on an outer surface of the sash at the room interior side. With this arrangement, the knob is manually operated to move the latch bolt into the body against the force of the spring, thus releasing the latch bolt from interlocking engagement with the jamb member. The sash is now allowed to undergo inward pivotal movement relative to the window frame.

The sill member has a first stopper member disposed on a top wall of the sill member, and a bottom rail of the sash has a second stopper member projecting downwards. The second stopper member is arranged such that it is vertically overlapped with the first stopper member at a position inwards of the first stopper member when the sash window is fully closed. With this arrangement, the first and second stopper members cooperate to limit deflection of the sash under high negative wind loads.

Another prior proposed improvement, such as disclosed in U.S. Pat. No. 6,243,999 B1, provides a sash window having a reinforcement mechanism for preventing the sash window from blowing outward during extreme storms. In the sash window, the reinforcement mechanism comprises a tongue-and-groove fitting structure formed jointly by a ridge or rib and a groove or recessed portion disposed between a bottom surface of the bottom rail of a sash and a top surface of the sill member of a window frame. When the sash is subjected to high positive wind loads or negative wind loads during extreme storms, the rib and the recessed portion engage together to thereby prevent the sash from blowing inward or outward under such high wind loads.

As for materials for frame members of the sashes, woods or synthetic resin materials such as polyvinyl chloride (PVC) are used in many cases in North America. In order to increase the strength of PVC sash frame members, a reinforcement member having a highly rigid cross-sectional shape is disposed inside a hollow frame member, such as described in U.S. Pat. No. 6,003,277.

According to U.S. Pat. No. 6,003,277, the hollow PVC sash frame and the PVC reinforcement member disposed inside the PVC sash frame are formed concurrently by a so-called "co-extrusion" process so that they are integrally connected together. The reinforcement member is hollow and has a particular cross-sectional shape that can provide high rigidity. An internal space of the hollow reinforcement member may be filled with another reinforcement member of PVC to provide an additional strength to the fame member.

The prior proposals discussed above are not fully satisfactory at least in terms of reinforcement or strengthening of sash windows against wind loads or impacts from flying objects during extreme storms.

SUMMARY OF THE INVENTION

A significant advantage of the present invention is to provide a sash window pivotable inward and sufficiently reinforced to withstand high positive wind loads or negative wind loads as well as severe impacts applied thereto from flying objects during extreme storms. Hurricanes are one example of such extreme storms. Accordingly, the present invention can be particularly advantageous when used near coastal locations.

In an embodiment of the invention, there is provided a sash window comprising a window frame including a head member, a sill member and a pair of jamb members connected together into a rectangular configuration; and at least one sash having a sash frame including a top rail, a bottom rail and a pair of side rails connected together into a rectangular configuration, and a panel member disposed within the sash frame, the sash being supported within the window frame and slidably movable along the jamb members between a fully closed position and a fully open position. The sash comprises a support device disposed on a lower end portion thereof and including a pivot shaft pivotally supporting the sash relative to the window frame, and a latch device disposed on an upper end portion of the sash and releasably engageable with each of the jamb members to lock the sash in position against pivotal movement relative to the window frame.

According to a first aspect of the present invention, the window frame has a holder member which receives the pivot shaft of the support device and prevents movement of the pivot shaft in an inward direction and an outward direction of the sash window when the sash is disposed in the fully closed position.

Preferably, the holder member is made of metal and includes an attachment portion fixed to the sill member and a protruding portion projecting along the jamb members. The protruding portion has a slit cut from an end edge of the protruding portion located remotely from the attachment portion, toward the attachment portion, the slit being receptive of the pivot shaft.

Because of the holder member, it is possible to keep the pivot shaft in position against movement when the sash is in the fully closed position. When the sash is subjected to high wind loads or heavy impacts from flying objects during extreme storms, the wind loads are exerted concentrically on the pivot shaft. In this instance, however, since the holder member serves as a reinforcement member of the pivot shaft, a support of the sash at the pivot shaft can be maintained.

According to a second aspect of the present invention, each of the jamb members has a portion adapted for engagement with the latch device when the sash is in the fully closed position, and a first reinforcement member is disposed on said portion of each jamb member and indirectly reinforces the jamb member portion from inside the jamb member.

Preferably, the jamb members are formed from synthetic resin material and each has a track along which the latch device is sidable while engaging the truck. The first reinforcement member is made of metal and fixedly mounted inside each jamb member at the portion adapted for engagement with the latch device when the sash is in the fully closed position.

With the first reinforcement member thus arranged, that portion of each jamb member adapted for interlocking engagement with the latch device is reinforced. When high wind loads or heavy impacts from flying objects are applied to the sash during extreme storms, concentration of wind loads can occur at the engagement portion between the latch device and the jamb member. In this instance, however, since the jamb member is reinforced at such engagement portion by the first reinforcement member, the interlocking engagement between the latch device and the jamb member can be maintained. The first reinforcement member is arranged to indirectly reinforce the jamb member from inside and is not exposed on the outside of the jamb member. Thus, the reinforcement member does not affect the appearance of the jamb member portion adapted for engagement with the latch device and does not deteriorate the visual design of the jamb member.

According to a third aspect of the present invention, the sash includes a second reinforcement member disposed in at least one of the top rail, bottom rail and each side rail.

In one preferred form of the invention, the second reinforcement member is disposed in at least the top rail of the sash and extends over the entire length of the top rail.

Preferably, the second reinforcement member comprises a metal member having a hollow cross-sectional shape and extends over the entire length of said at least one rail, and a filler filled in an internal space of the hollow metal member or a space defined between the hollow metal member and said at least one rail.

By providing the second reinforcement member, it is possible to increase the strength of the respective sash rails to the extent that the sash can withstand high wind loads or heavy impacts from flying objects that may be applied during extreme storms. In general, the movable sash is disposed in a lower section of the window frame with the result that the top rail of such movable sash is disposed horizontally at a central portion of the widow frame. In this arrangement, it is particularly effective to place the second reinforcement member inside the top rail for the purpose of reinforcing the central portion of the window frame against damage during extreme storms. In the case where the second reinforcement member is arranged to extend over the entire length of each sash rail, this arrangement is advantageous not only because the sash rail is necessarily reinforced over the entire length thereof but also because loads exerted on one sash rail can be effectively and reliably transferred to an adjacent sash rail.

The sash window may further comprise a first fastener member joining together said at least one rail and the second reinforcement member incorporated therein, and/or a second fastener member joining together a fixture or hardware disposed on an outside surface of said at least one rail and the second reinforcement member incorporated therein. The fixture or hardware may include a lock device, a handle and the like.

By joining the sash rail and the reinforcement member by the first fastener, loads on the sash rail are effectively and reliably transmitted to the reinforcement member, which will improve the reinforcing effect achieved by the reinforcement member. Similarly, in the case where the hardware and the reinforcement member is joined by the second fastener, loads on the hardware are effectively and reliably transmitted to the reinforcement member and, which will lead to an improved reinforcing effect achieved by the reinforcement member.

Preferably, the window frame has a slit formed in at least one of the head member, sill member and each jamb member, and a cover member mounted to cover the slit. The cover member includes a base portion fitted with the slit, a protruding portion integral with and projecting from the base portion and extending continuously in a longitudinal direction of the base portion, and a seal member mounted on the protruding portion and sealingly engageable with a mating one of the rails of the sash.

By providing the cover member, it is possible to improve the fluid-tightness (air-tightness and water-tightness) between the sash and the window frame.

It is preferable that the window frame further includes a displacement prevention member having a base portion attached to at least one of the head member, sill member and each jamb member and a protruding portion integral with and projecting from the base portion and extending continuously in a longitudinal direction of the base portion. The protruding portion is engageable with a part of a mating one of the sash rails to prevent movement of the mating sash rail in the inward direction and/or the outward direction of the sash window.

By preventing inward and outward movement of the sash rail by the displacement prevention member, it is possible to increase the mount strength of the sash relative the window frame to the extent that the sash window can retain a sufficient structure to withstand high wind loads or heavy impacts from flying objects applied to the sash during extreme storms.

According to a fourth aspect of the present invention, the upper end portion of the sash includes a latch cover mounted along a side surface thereof facing a mating member, so as to cover a portion of the sash where the latch device is installed.

The latch cover may be formed from a rigid plate of metal and is fixedly mounted along a side surface of each side rail. The latch cover is preferably configured to have an opening for allowing passage therethrough of the latch bolt of the latch device for interlocking engagement with the mating jamb member. The opening has a shape complementary in contour to the shape (cross-sectional shape) of the latch bolt and has a size equal to or slightly larger than a size of the contour of the latch bolt. The opening allows passage of the latch bolt without undue interference. When the latch bolt is subjected to a load acting in the depth direction of the window under the effect of an external force applied to the sash, the peripheral edge of the opening can retain the latch bolt to thereby reinforce the latch bolt. The peripheral edge of the opening and an outer peripheral surface of the latch bolt should not be held in intimate or close contact with each other at all times. They are allowed to separate from one another to ensure smooth or resistance-free passage of the latch bolt through the opening. The latch cover needs to be engageable with the latch bolt to assist supporting of the latch bolt when the sash is deflected by the effect of an external force.

The foregoing reinforcements may be utilized in combination so that the overall strength of the sash window increases greatly. Stated more specifically, the reinforcement member disposed in each sash rail for increasing the strength of the sash, the reinforcement member disposed at a latch engagement portion of each jamb, and the holder member serving also as a reinforcement member for the pivot shaft may be employed concurrently to increase the mount strength of the sash relative to the window frame. Each of the foregoing reinforcement members can achieve a prescribed reinforcement effect even when used alone, but when used in combination, the reinforcement members can provide multiplied effects. Embodiments of the present invention may have various features or aspects and provide various advantages. Any of the features, aspects and advantages of the present invention may be desired, but, are not necessarily required to practice the present invention.

BRIEF DESCRIPTION OF THE DRAWINGS

A preferred structural embodiment of the present invention will be described in detail herein below, by way of example only, with reference to the accompanying sheets of drawings, in which.

DETAILED DESCRIPTION OF THE PREFERRED EMBODIMENT

The general arrangement of a double-hung window 1 constituting a sash window according to an embodiment of the present invention will be described below in greater detail with reference to FIGS. 1 to 5.

Figure 1:
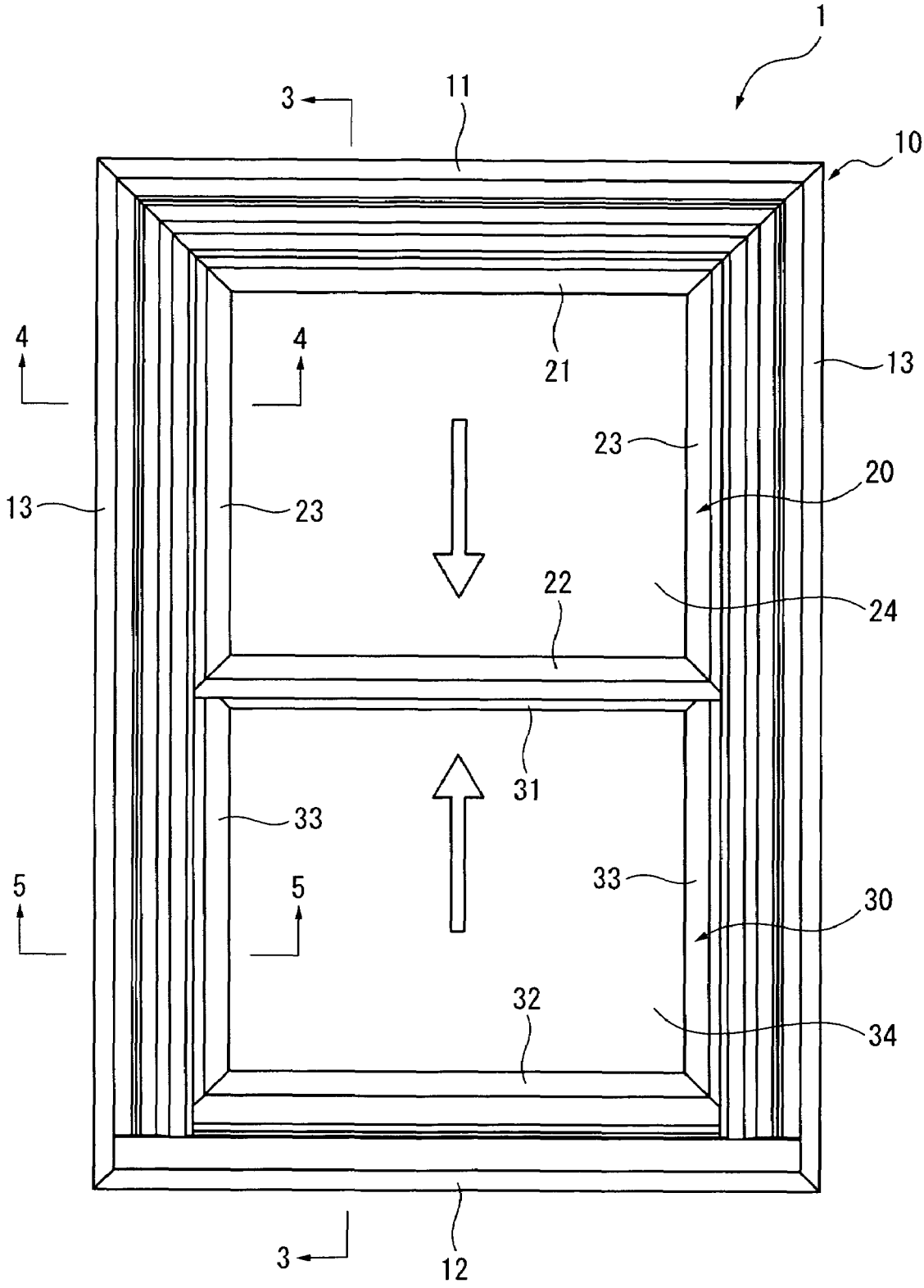
FIG. 1 is a front elevational view of a sash window according to an embodiment of the present invention looking from an exterior side of the sash window.

As shown in FIG. 1, the double-hung window 1 is installed in an opening in the exterior wall of a building, such as a house, for separating an interior space and an exterior space of the building. The double-hung window 1 comprises a window frame 10 including a head member 11, a sill member 12 and a pair of side or jamb members 13, 13 connected together into a rectangular shape, and an upper sash 20 and a lower sash 30 movably supported within the window frame 10. The double-hung window 1 may further include a fixed or slidable wire screen on the outside at the window frame 10, and a fixed or drawable blind on the inside at the window frame 10.

The upper and lower sashes 20 and 30 each have a sash frame including a top rail 21, 31, a bottom rail 22, 32, and a pair of side rails or stiles 23, 33 connected together into a rectangular shape, and a panel of glazing (double-glazing) 24, 34 held within the sash frame.

Figure 2:
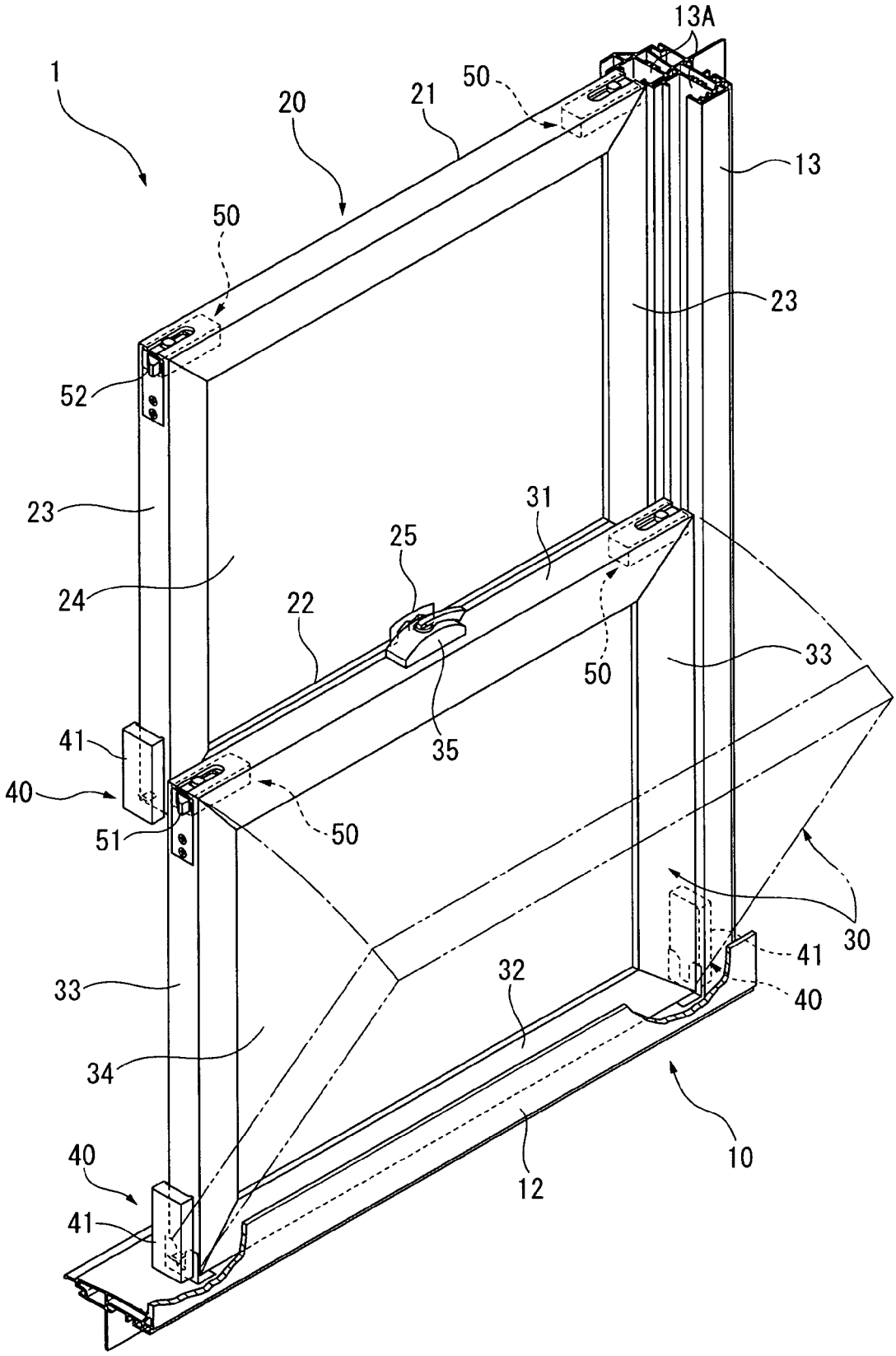
FIG. 2 is a schematic perspective view of the sash window looking from an interior side thereof.
Figure 3:
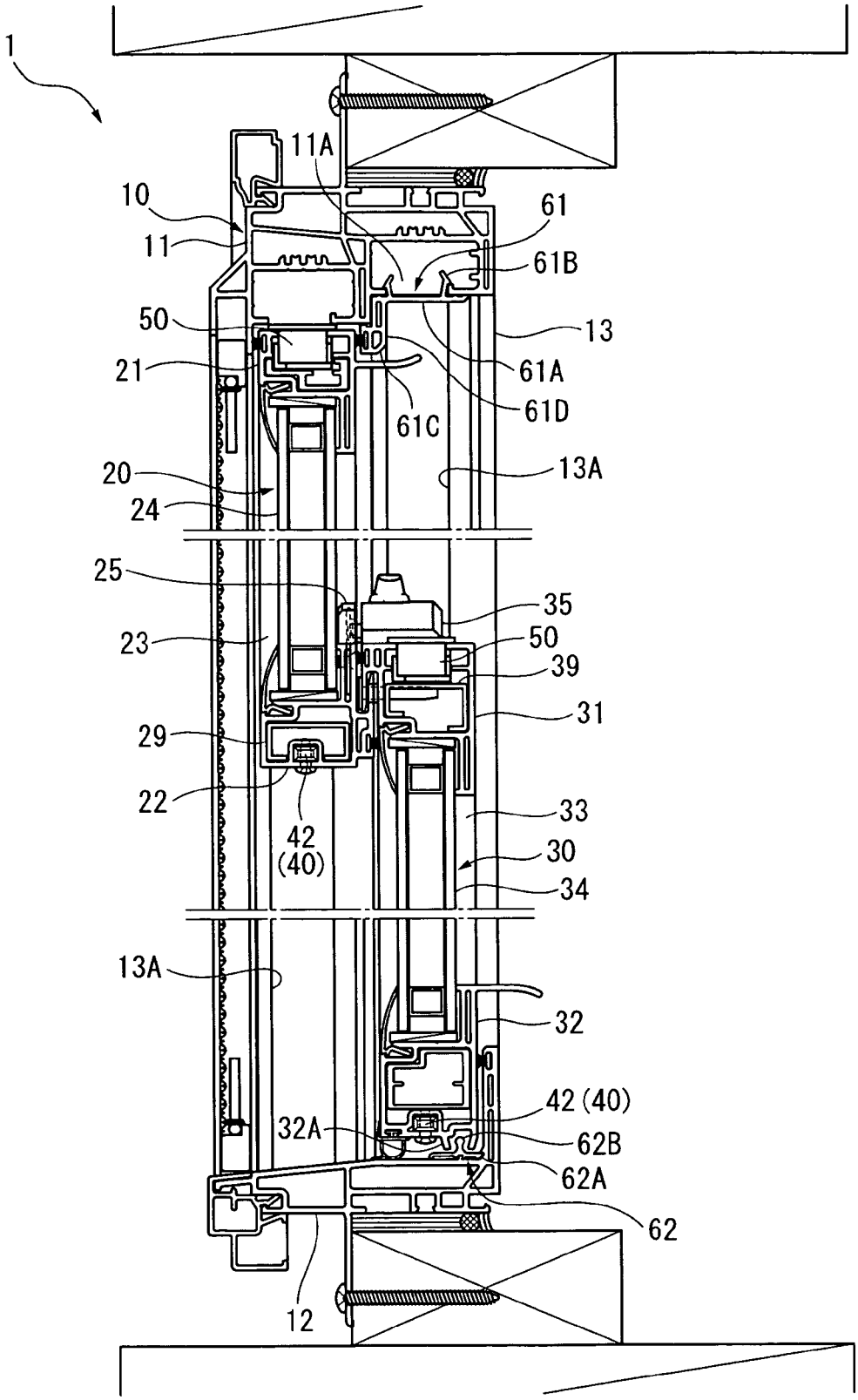
FIG. 3 is a cross-sectional view taken along line 3-3 of FIG. 1.

As shown in FIGS. 2 and 3, when viewed in a direction which is perpendicular to a central plane within the window frame 10, the upper sash 20 is offset from the central plane within the window frame 10 toward the exterior side of the window 1, while the lower sash 30 is offset from the central plane toward the interior side of the window 1. In the illustrated embodiment, the upper sash 20 and the lower sash 30 are supported and guided by the jamb members 13, 13 of the window frame 10 for vertical sliding movement along the jamb members 13 to open and close the window 1 (double-hung type). In another embodiment, the upper sash 20 may be fixed while being positioned by the head member 11 and the jamb members 13 of the window frame 10. In this instance, the lower sash 30 is vertically slidable to open and close the window 1 (single-hung type).

The double-hung window 1 is in a fully closed state when the upper sash 20 is disposed in an upper limit position of its vertical movement and the lower sash 20 is in a lower limit position of its vertical movement. In this state, the bottom rail (outer meeting rail) 22 of the upper sash 20 and the top rail (inner meeting rail) 31 of the lower sash 30 are overlapped in the depth direction of the window frame 10. The top rail 31 of the lower sash 30 has a crescent lock 35, and the bottom rail 22 of the upper sash 20 has a crescent keeper 25 so that when the crescent lock 35 is engaged with the crescent keeper 25 with the upper and lower sashes 20 and 30 placed in a closed state, the double-hung window 1 in the fully closed state is locked in position.

Each of the upper and lower sashes 20, 30 includes a pair of support devices 40 disposed on lower end portions of each sash, respectively, at opposite sides thereof, and a pair of latch devices 50 disposed on upper end portions of each sash 20, 30, respectively, at opposite sides thereof. The support devices 40 and the latch devices 50 are guided by the jamb members 13 of the window frame 10 so that the upper and lower sashes 20, 30 are vertically slidable within the window frame 10.

Figure 4:
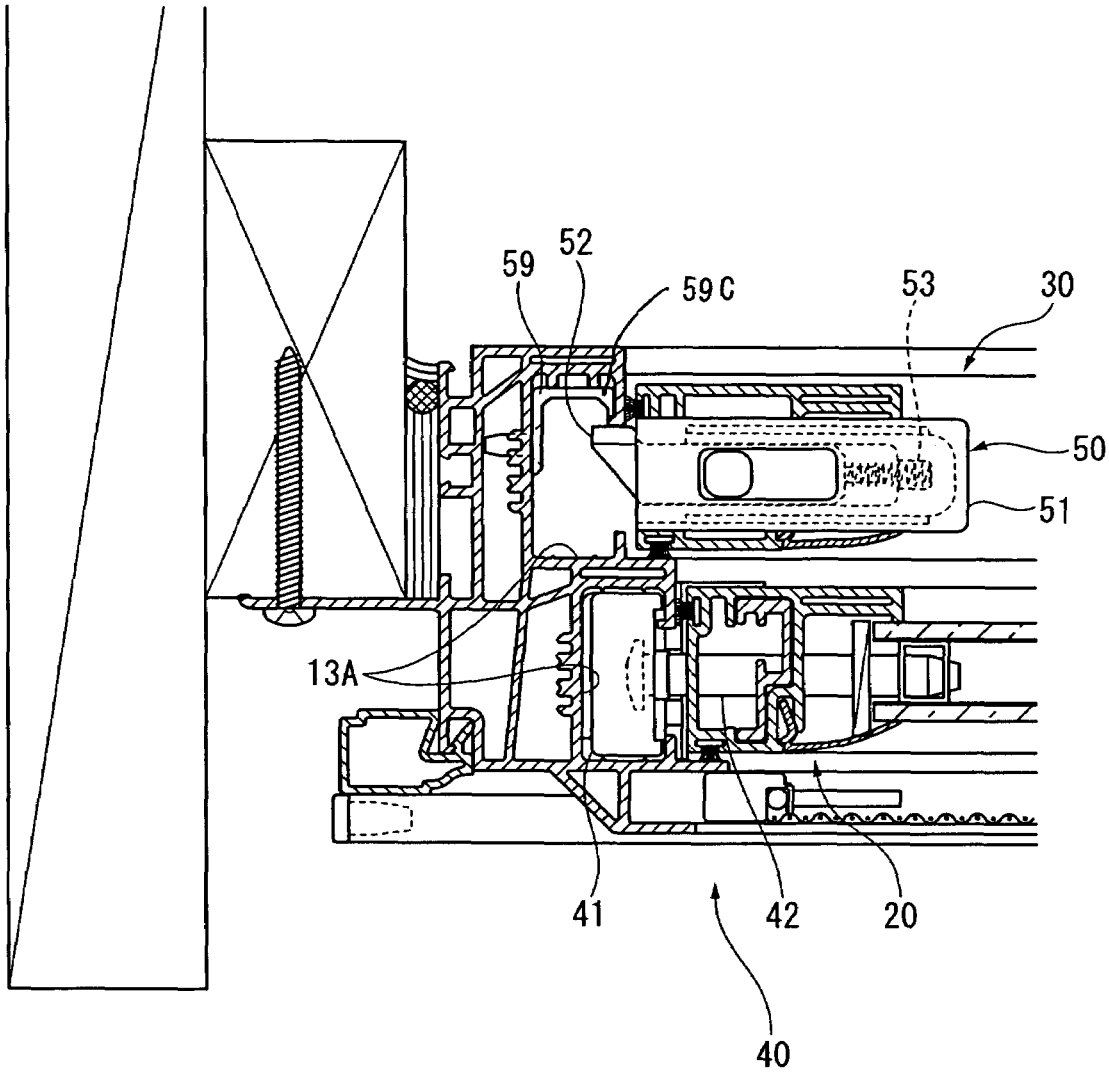
FIG. 4 is a cross-sectional view taken along line 4-4 of FIG. 1.
Figure 5:
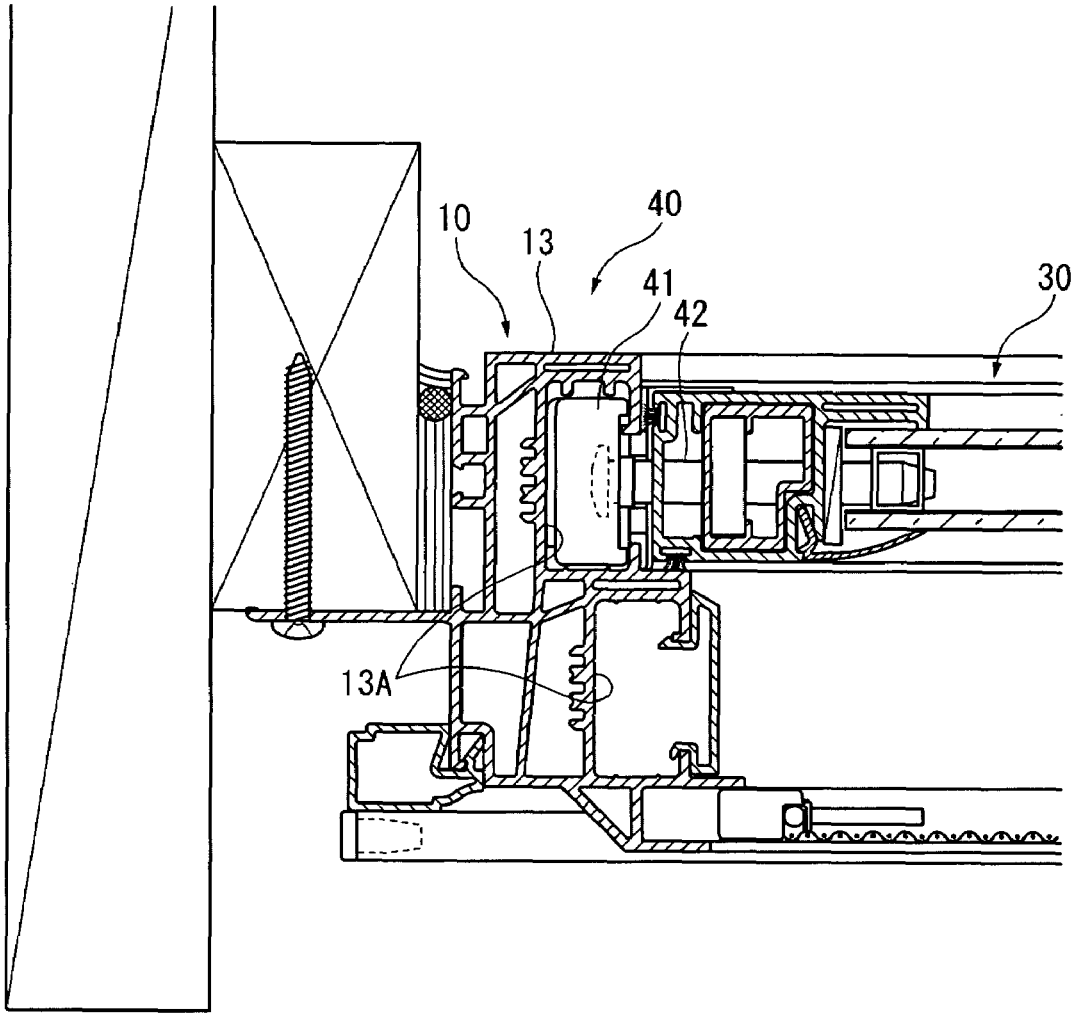
FIG. 5 is a cross-sectional view taken along line 5-5 of FIG. 1.

As shown in FIGS. 4 and 5, each of the support devices 40 includes a block-like slide shoe 41 and a pin 42 connecting the slide shoe 41 to the upper or lower sash 20, 30. The pin 42 serves as a pivot shaft as will be described later. The slide shoe 41 is held within a guide rail or track 13A formed in each jamb member 13 and slidable in a vertical direction along the jamb member 13. The slide shoe 41 is connected to a load bearing mechanism (not shown) for supporting a weight of the upper or lower sash 20, 30. The load bearing mechanism may be a conventional structure used in an appropriate manner, for example, a structure including a counterweight or balancer connected via a wire, a structure including a helical spring for supporting the load, or the like.

As shown in FIG. 4, each of the latch devices 50 includes a box-like case 51, a latch bolt 52 retractably held in the case 51 with one end portion (front end portion) thereof projecting from an end of the case 51, and a compression coil spring 53 disposed in the case 51 for urging the latch bolt 52 in a direction projecting outward from the case 51. The case 51 has an opening formed in an upper wall thereof so that the latch bolt 52 is partially exposed to view through the opening. Thus, by manually operating an exposed part of the latch bolt 52, the latch bolt 52 can move in a direction to compress the coil spring 53. The case 51 is held inside opposite end portions of the top rails 21, 31, and the front end portion of the latch bolt 52 is normally disposed in an operating position in which the front latch bolt end projects outward from an upper end portion of each side rail 23, 33. The projecting front end portion of the latch bolt 52 is sidable in a vertical direction along the track 13A in each jamb member 13 of the window frame 10.

The upper and lower sashes 20, 30 are vertically slidable with the support devices 40 and the latch devices 50 guidedly received in the tracks 13A of the jamb members 13. Furthermore, when the latch devices 50 are manually operated to disengage from the jamb members 13, the lower sash 30 becomes pivotable inwardly into an inward tilt position indicated by the phantom lines shown in FIG. 2 as the pins 42 of the support devices 40 serve as pivot shafts on the lower sash 30. In order to limit pivotal movement of the lower sash 30 in an inward direction of the window 1, each of the side rails 33 of the lower sash 30 and a corresponding one of the jamb members 13 of the window frame 10 are connected together by an arm (not shown).

By tilting the lower sash 30, an outside surface of the lower sash 30 can be cleaned from the room interior side of the window 1. In general, the foregoing pivot operation is applied only to the lower sash 30 for enabling cleaning of the outside surface of the lower sash 30. This is because an outside surface of the upper sash 20 is readily accessible for cleaning when the lower sash 30 is in the open state. However, the upper sash 20 may be configured to become pivotable.

In the illustrated embodiment, the head, sill and jamb members 11, 12 and 13 of the window frame 10 and the top rails 21, 31, bottom rails 22, 32 and side rails 23, 33 of the upper and lower sashes 20, 30 are extrusion molded from synthetic resin into elongated members of particular profiles shown in the drawing figures, the elongated members being subsequently assembled together into rectangular frames. The synthetic resin material may include polyvinyl chloride (PVC). The material for the window frame 10 and sashes 20, 30 should by no means be limited to the synthetic material but may include wood, metal such as aluminum alloy, or a combination of these materials.

The double-hung window 1 of the foregoing construction includes a reinforcement structure disposed at various portions thereof, as will become apparent from a description given below.

In the illustrated embodiment, the bottom rail 22 of the upper sash 20 and the top rail 31 of the lower sash 30 are disposed in juxtaposition at a meeting portion of the window 1. The bottom rail 22 and the top rail 31 have reinforcement members 29, 39 disposed respectively therein.

Figure 6:
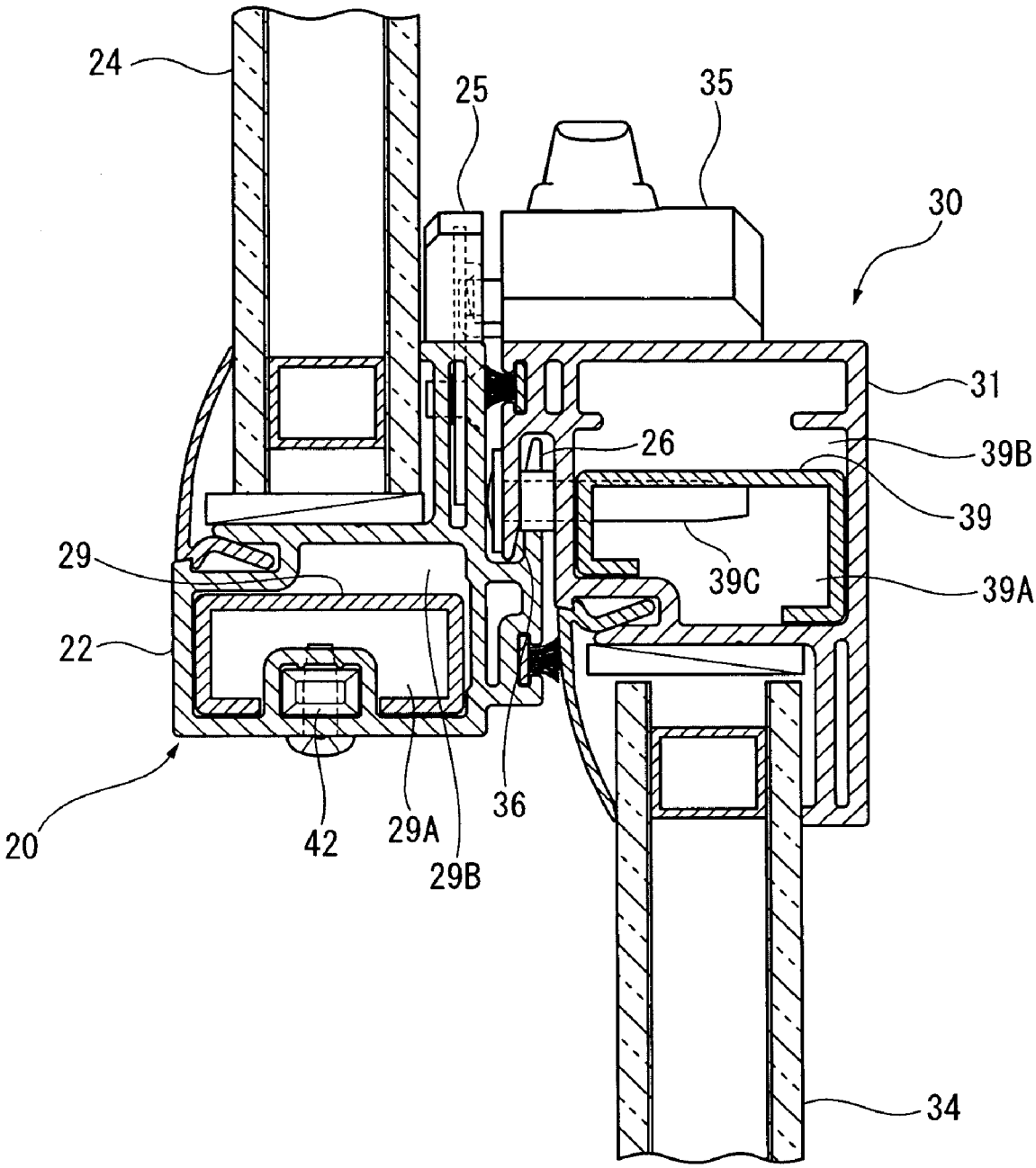
FIG. 6 is a cross-sectional view showing meeting rails of the sash window.

As shown in FIG. 6, the reinforcement members 29, 39 each comprise an elongate member of C-shaped cross-section. As a material for the reinforcement members 29, 39, an aluminum alloy is most preferable for its lightweight and high rigidity. The aluminum alloy may be replaced by any other metal or fiber-reinforced plastics. The cross-sectional shape of the reinforcement members 29, 39 is not limited to the C-shape as in the illustrated embodiment but may include an L-shape, J-shape, T-shape, rectangular shape, or any other shape as long as it provides the reinforcement members 29, 39 with a high rigidity and is suitable for accommodation of the reinforcement members 29, 39 into the corresponding rails 22, 31.

Each of the reinforcement members 29, 39 is held inside a corresponding one of the rails 22, 31 with its plural surfaces held in close contact with an inner circumferential surface of each rail 22, 31. Each reinforcement member 29, 39 has opposite ends extended to the opposite ends of the bottom rail 22 or the top rail 31 so that the rails 22, 31 are reinforced along the entire lengths thereof.

The reinforcement members 29, 39 remarkably increases the flexural rigidity of the bottom and top rails 22 and 31. When a similar reinforcement member is also disposed in the side rails 23, 33, the top rail 21 of the upper sash 20 and the bottom rail 32 of the lower sash 30, it is preferable to connect adjacent ends of the reinforcement members so that the reinforcement members disposed inside the rails of each sash 20, 30 jointly form a rectangular framework structure. To connect the adjacent reinforcement members any sort of conventional techniques, such as an L-shaped joint with parts inserted in opposed ends of the reinforcement members, can be used.

An internal space of each of the reinforcement member 29, 39 and a space between each reinforcement member 29, 39 and a corresponding one of the bottom rail 22 and the top rail 31 are filled with fillers as at 29A, 39A, 29B and 39B. The fillers 29A, 39A, 29B, 39B are provided into the respective spaces in a flowable condition and foam or expand within the spaces to fill the latter. After a predetermined period of time has passed thereafter, the fillers 29A, 39A, 29B, 39B become solidified in a foamed or expanded condition and form blocks having a higher rigidity than a predetermined reference value. Materials commercially available for the production of the fillers 29A, 39A, 29B and 39B include "Speedbonder Stuctural Adhesive" and "Hysol Epoxy Adhesive", both trade names of Loctite Corporation.

Because of the rigidity of the fillers 29A, 39A, 29B, 39B, the flexural rigidity of the bottom and top rails 22 and 31 is enhanced and the rigidity of the reinforcement members 29, 39 is enhanced as the reinforcement members 29, 39 are confined in shape and configuration by the fillers 29A, 39A, 29B, 39B.

As described above, the bottom rail 22 of the upper sash 20 and the top rail 31 of the lower sash 30 in the illustrated embodiment are reinforced by the reinforcement members 29 and 39, respectively. In this arrangement, when the lower sash 30 is subjected to a strong inward wind pressure or load, the top rail 31 of the lower sash 30 tends to flex or distort toward the room interior side, forming a space or gap between the top rail 31 and the bottom rail 22. To avoid this problem from occurring, the top rail 31 and the reinforcement member 39 disposed therein are fastened together into a unitary structure by means of screws 39C (only one being shown in FIG. 6) extending from an outside surface of the top rail 31 through a peripheral wall of the reinforcement member 39 into the filler 39A. By joining the top rail 31 and the reinforcement member 39, the rigidity of the top rail 31 is further increased.

From an aesthetic point of view, the screws 39C are arranged on the exterior side of the top rail 31. On the exterior side of the top rail 31 there is provided a labyrinth seal formed between the top rail 31 and the bottom rail 22. The labyrinth seal is configured to allow movement of the screws 39C in a vertical direction without interference with the labyrinth seal, as will be described later.

Figure 7:
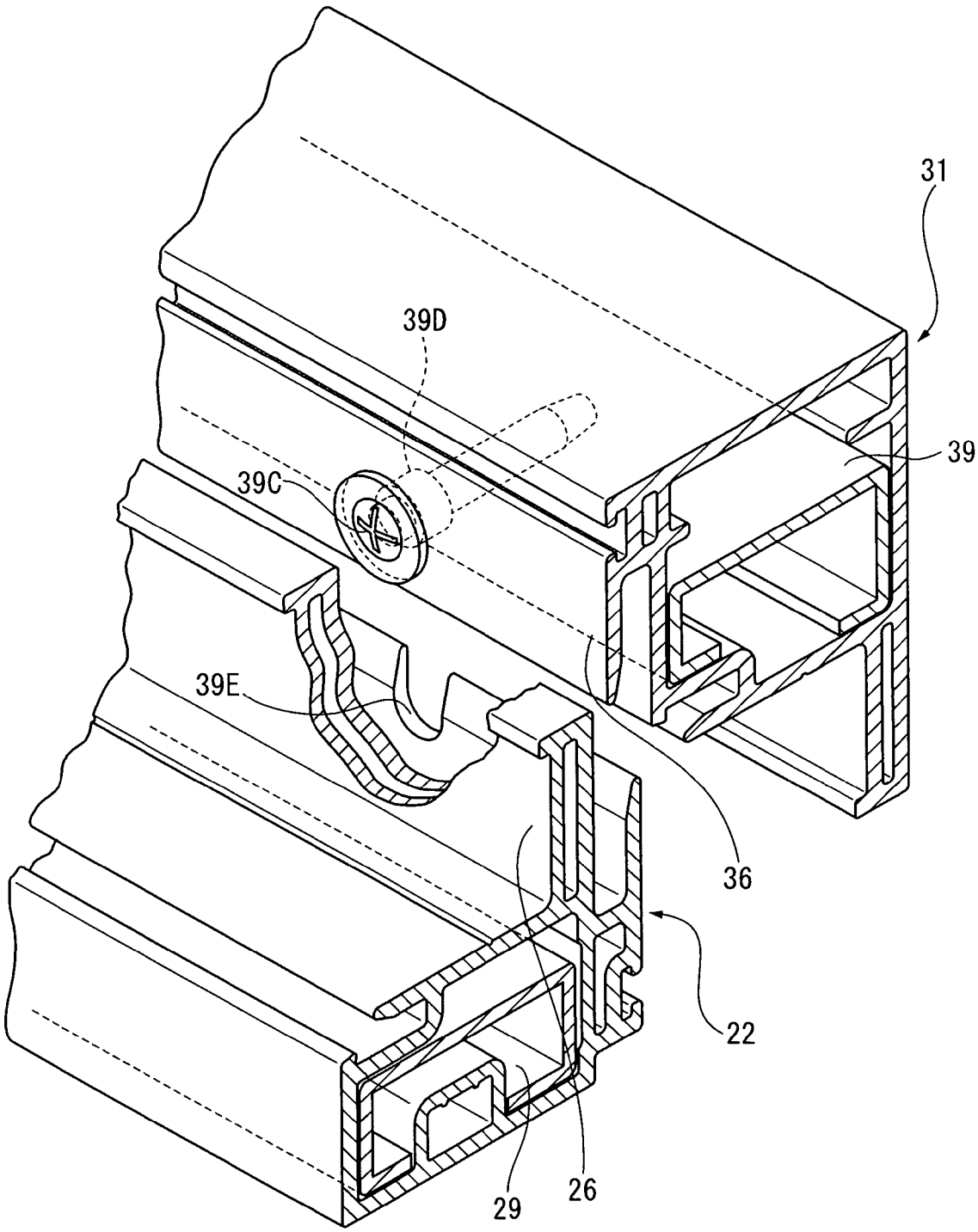
FIG. 7 is a perspective view, with parts cutaway for clarity, of a labyrinth seal provided between the meeting rails.

As also shown in FIG. 7, the bottom rail 22 has on its inside surface an upwardly oriented flange 26, and the top rail 31 has on its outside surface a downwardly oriented flange 36. When the sashes 20, 30 are disposed in the fully closed position, these flanges 26, 36 are interlocked with each other to thereby form a labyrinth seal. Each screw 39C passes through the flange 36 from an exterior side thereof and further extends into the top rail 31 and the reinforcement member 39 disposed therein.

A cylindrical collar 39D may be fitted around a portion of the screw 39C extending between the flange 36 and the outside surface of the top rail 31. The flange 26 has cutout recesses (only one shown) 39E formed at a top end edge thereof at portions corresponding in position to the respective screws 39C to allow movement of the screws 39C into and out of the respective cutout recesses 39E when the upper sash 20 and the lower sash 30 move relative to each other in a vertical direction. The cutout recesses 39E allow the labyrinth seal to maintain its prescribed function and opening and closing operations of the upper and lower sashes 20 and 30 can be achieved smoothly even though the screws 39C are provided at the same position as the labyrinth seal.

As previously described, the upper sash 20 and the lower sash 30 are in engagement with the tracks 13A on the respective jamb members 13 via the support devices 40 and the latch devices 50, and these sashes 20, 30 are slidable in a vertical direction along the jamb members 13. Each of the jamb members 13 has a reinforcement member 59 disposed therein so as to provide the track 13A with a strength sufficient to withstand a concentrated load or force applied from the latch bolt 52 of each latch device 50.

Figure 8:
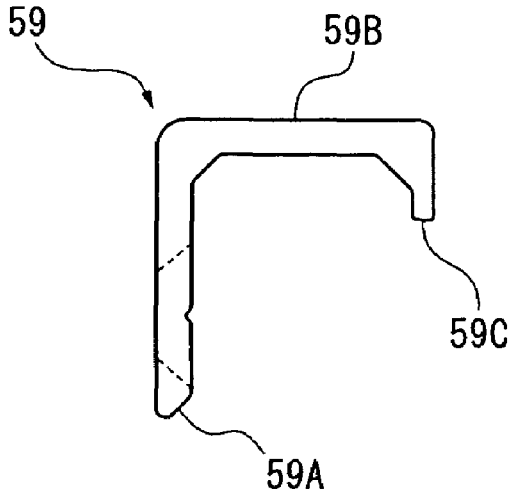
FIG. 8 is a plan view showing a reinforcement member for a latch used in the sash window.
Figure 9:
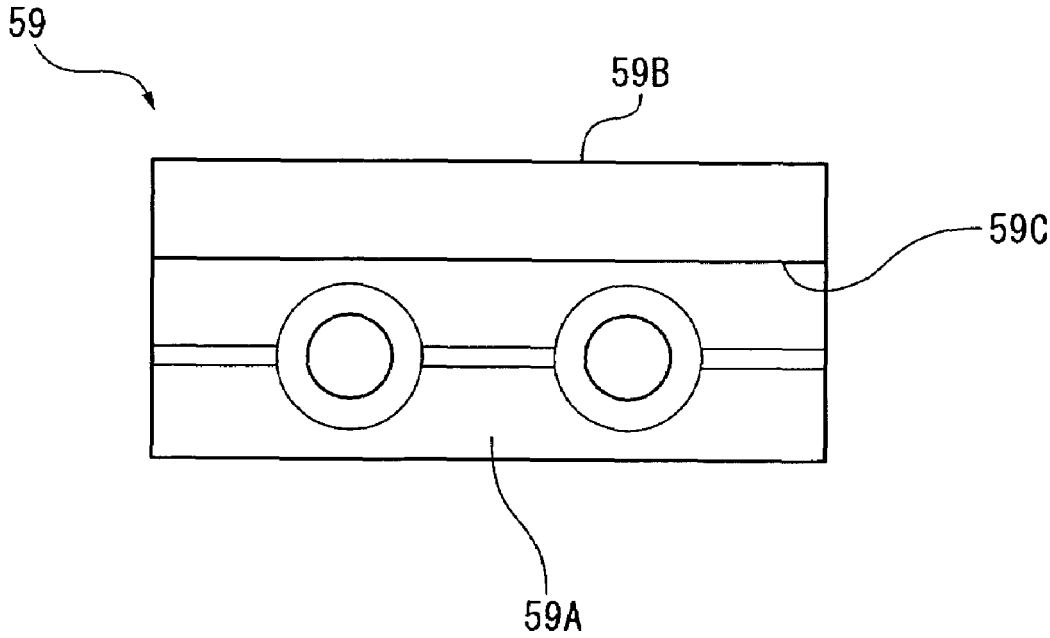
FIG. 9 is a side view of the reinforcement member.

As shown in FIGS. 8 and 9, the reinforcement member 59 is a relatively short strip member of J-shaped cross-section including an attachment portion 59A, a connecting portion 59B and an abutment portion 59C. The reinforcement member 59 is formed by extrusion from an aluminum alloy into an elongated J shape or section, followed by cutting the elongated J shape into strips of individual lengths. The reinforcement member 59 is received in the track 13A of each jamb member 13 and firmly secured at the attachment portion 59A to the track 13A by means of a pair of screws (not shown) extending respectively through a pair of holes (not designated) formed in the attachment portion 59A.

As shown in FIG. 4, the abutment portion 59C of the reinforcement member 59 is disposed behind one longitudinal edge of the track 13A with which the latch bolt 52 is slidably engaged, so that the abutment portion 59C can indirectly bear a load or force applied from the latch bolt 52.

The reinforcement member 59 serves to indirectly reinforce or strengthen each jamb member 13 from inside and is not exposed on the outside of the jamb member 13. Thus, the reinforcement member 59 does not affect the appearance of the jamb member 13 and does not deteriorate the visual design of the jamb member 13.

The reinforcement member 59 is positioned at the same vertical level or height as a portion of the track 13A with which the latch bolt 52 of each latch device 50 is in engagement when the lower sash 30 or the upper sash 20 is in the fully closed state. The reinforcement member 13 may be mounted to extend over the entire length of the jamb 13, but a sufficient effect can be attained even when the reinforcement member 59 is disposed only at a portion of the track 13A engageable with the latch bolt 52 of the latch device 50 when each sash 20, 30 is in its fully closed position.

Figure 10:
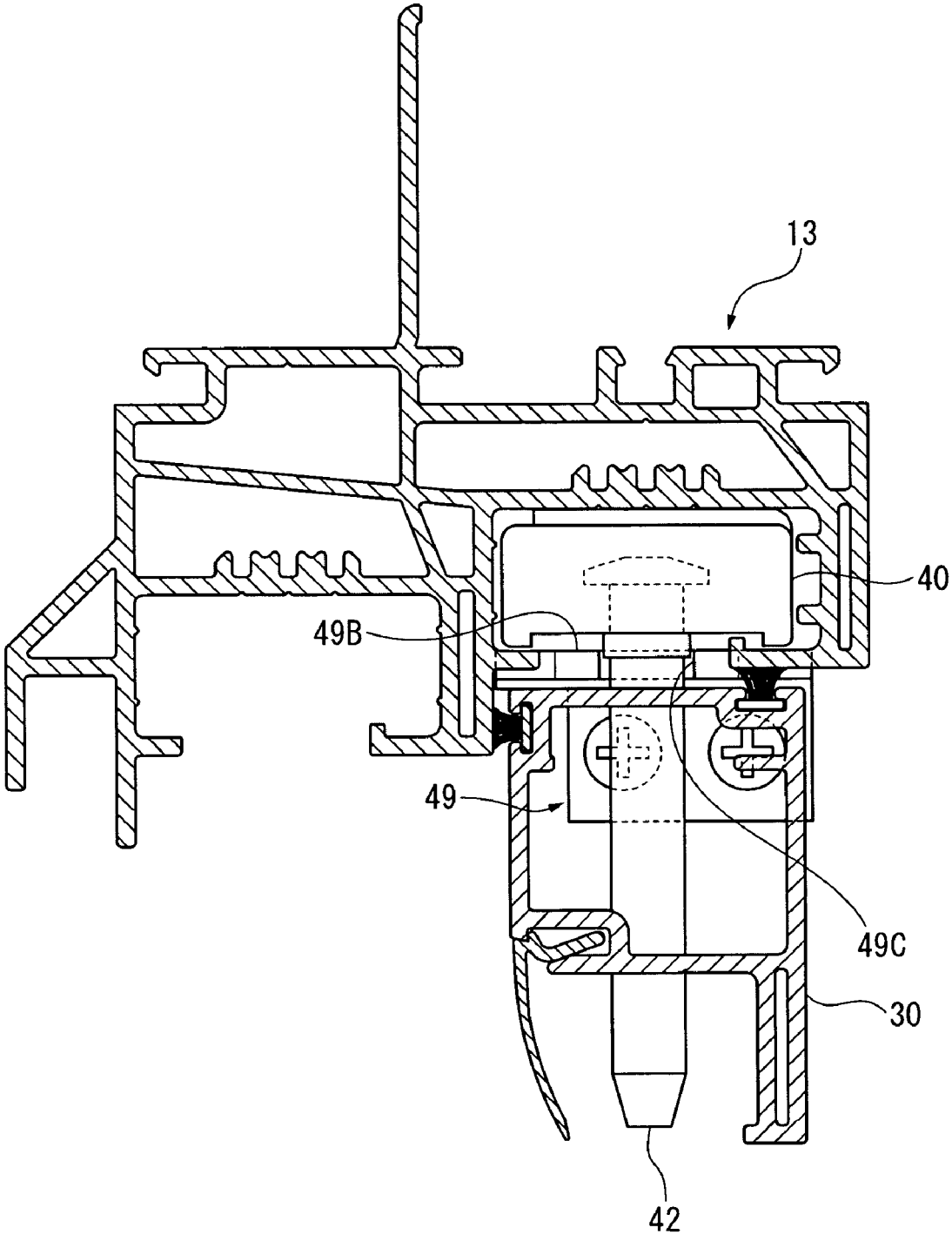
FIG. 10 is a plan view, with parts cutaway for clarity, of a support member at a lower end of a sash of the sash window.
Figure 11:
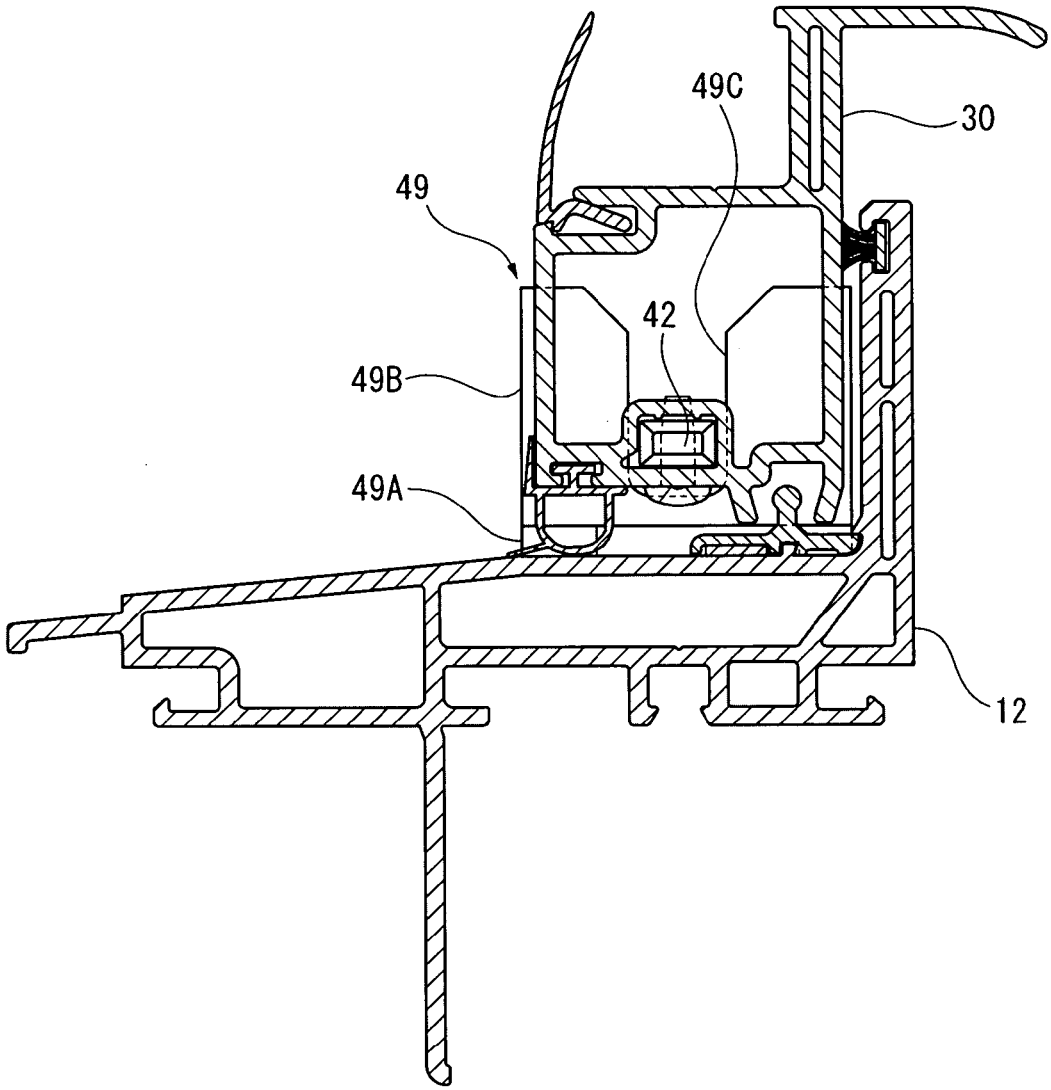
FIG. 11 is a side view, with parts cutaway for clarity, of the support member.
Figure 12:
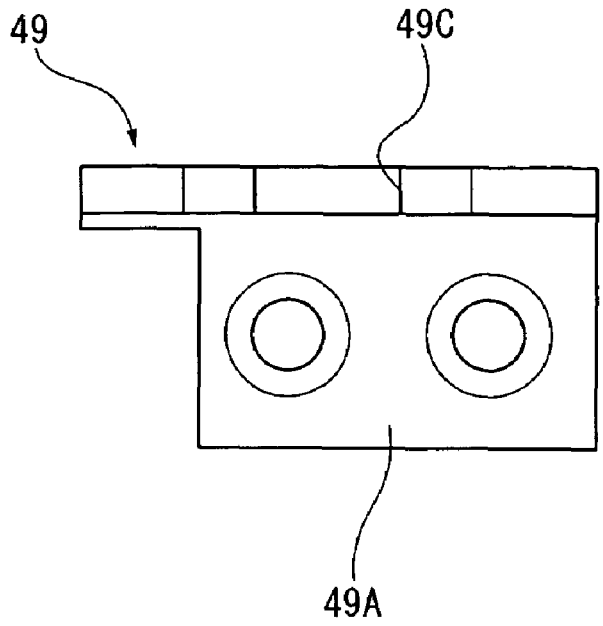
FIG. 12 is a plan view showing a holder member for a pivot shaft incorporated in the sash window.
Figure 13:
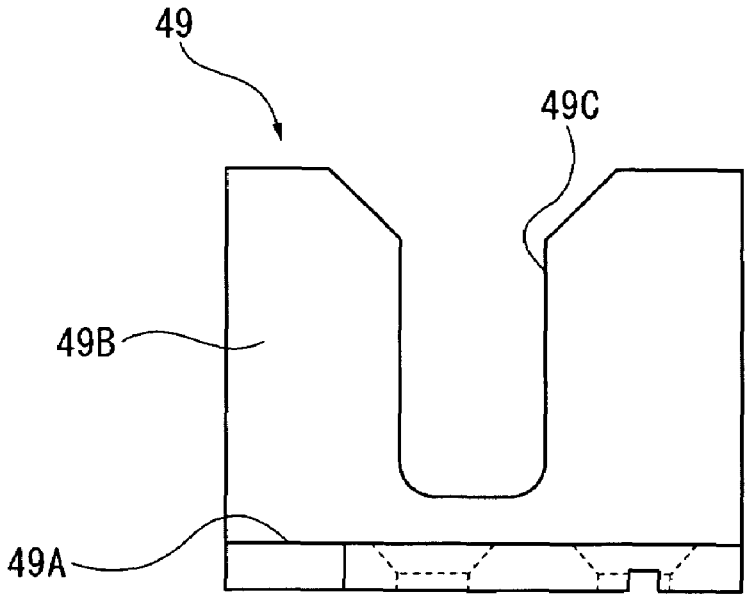
FIG. 13 is a side view of the holder member.

As shown in FIGS. 10 and 11, a holder member 49 for holding the pin (pivot shaft) 42 of each support device 40 is disposed on the sill member 12 at opposite end portions thereof located adjacent lower ends of the respective jamb members 13. As also shown in FIGS. 12 and 13, the holder member 49 is an L-shaped member including an attachment portion 49A and a protruding portion 49B extending at right angles from each other. The L-shaped holder member 49 is formed by extrusion from an aluminum alloy into an elongated L shape or section, followed by cutting the elongated L shape into strips of individual lengths. The holder member 49 is firmly secured to an upper surface of the sill member 12 by means of a pair of screws (not shown) extending respectively through a pair of holes (not designated) formed in the attachment portion 49A.

Referring back to FIGS. 10 and 11, in an attached or installed condition of the holder member 49, the protruding portion 49B of the holder member 49 projects upwards along an inner surface of one sidewall of each jamb member 13 that is located on an interior side of window. The protruding portion 49B may project upwards from the attachment portion 49A so as to form a lower end extension of the one sidewall of each jamb member 13. The protruding portion 49B has a slit 49C cut from an upper end of the protruding portion 49B. The slit 49C is located at a position vertically aligned with a path of movement of the pin (pivot shaft) 42 when the lower sash 30 slides along the jamb members 13 in a vertical direction. The slit 49C has a minimum width substantially equal to or slightly greater than an outside diameter of the pin (pivot shaft) 42. With this arrangement, when the lower sash 30 is disposed in its fully closed position, the pin (pivot shaft) 42 is guidedly received in the slit 42C and hence is prevented from moving a depth direction of the window (i.e., both in an outward direction and in an inward direction of the window). By locking the pin (pivot shaft) 42 in position against movement in the depth direction of the window, it is possible to bear a wind pressure or load applied to the lower sash 30.

As shown in FIG. 3, the head member 11 has a slit 11A formed in a bottom wall thereof so as to extend along an area of the bottom wall vertically aligned with the lower sash 30. The slit 11A is connected to an internal space of the head member 11 and extends over the entire length of the head member 11. The head member 11 also has a cover member 61 snap-fit with the slit 11A to close the slit 11A.

Like a conventional cover used in a similar portion of the window, the cover member 61 includes a base portion 61A extending to cover the slit 11A and a pair of locking legs 61B integral with the base portion 61A and lockingly engaged with a pair of opposed longitudinal edges of the slit 11A. The cover member 61 further has a protruding portion 61C projecting downwards from one longitudinal edge of the base portion 61A and extending continuously in a longitudinal direction of the slit 11A, and a seal member 61D formed from elastomeric material such as rubber and mounted on a front end edge of the protruding portion 61C. When the upper sash 20 is in the fully closed position, the protruding portion 61C is arranged to extend along an exterior surface of the top rail 21 of the upper sash 20, and the seal member 61D is in sealing contact with the interior surface of the top rail 21. With this sealing contact between the seal member 61 and the interior top rail surface, the cover member 61 is able to provide a hermetic seal and a waterproof seal between the upper sash 20 and the window frame 10.

The cover member 61 may be extrusion molded from synthetic resin material in a similar manner as the head member 11. The position of the cover member 61 should not be limited to the head member 11 as in the illustrated embodiment but may include a sill member 12 or each jamb member 13. In the case where the upper sash 20 is formed as a fixed sash, the cover member 61 is mounted to cover a part of the track 13A of each jamb member 13 extending below the upper sash 20 in an exposed condition.

In FIG. 3, the sill member 12 has a displacement prevention member (sill attachment) 62 firmly secured to an upper surface of the sill member 12 so as to extend over an area vertically aligned with the lower sash 30.

Figure 14:
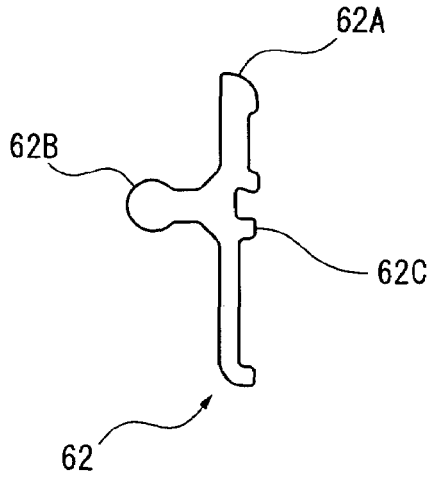
FIG. 14 is a side view of a displacement prevention member for use in the sash window.
Figure 15:
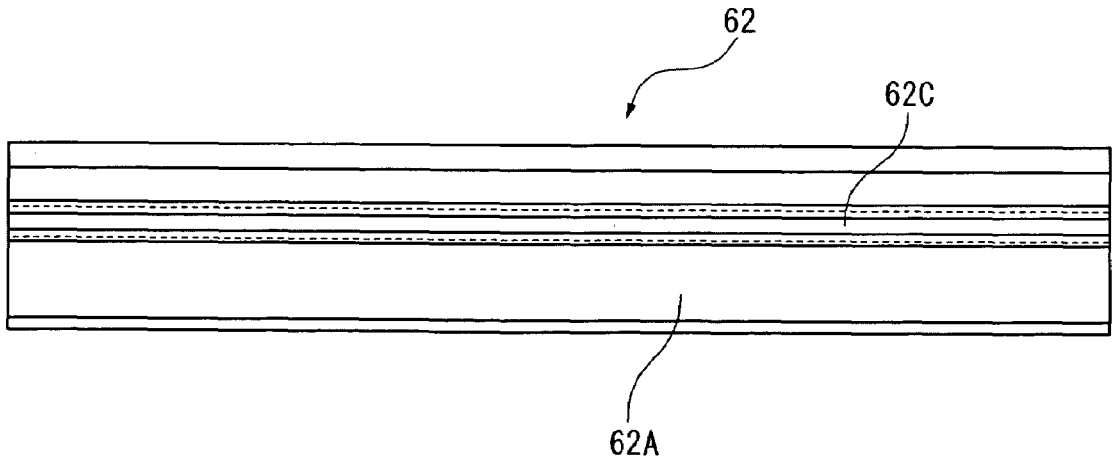
FIG. 15 is a plan view of the displacement prevention member.

As shown in FIGS. 14 and 15, the displacement prevention member 62 has a generally T-shaped cross section and includes a base portion 62A and a protruding portion 62B uprising from a front surface of the base portion 62A and extending continuously over the entire length of the base portion 62A. The displacement prevention member 62 also has a longitudinal groove 62C formed in a rear surface of the base portion 62A in order to form one part of a ridge-and-groove fitting structure that has both a positioning function and a load-transmitting function. The displacement prevention member 62 preferably has a sufficient level of rigidity and is made of metal such as aluminum alloy. As an alternative, fiber-reinforced plastic material or a like material having a sufficient level of rigidity can be used for forming the displacement prevention member 62.

Figure 16:
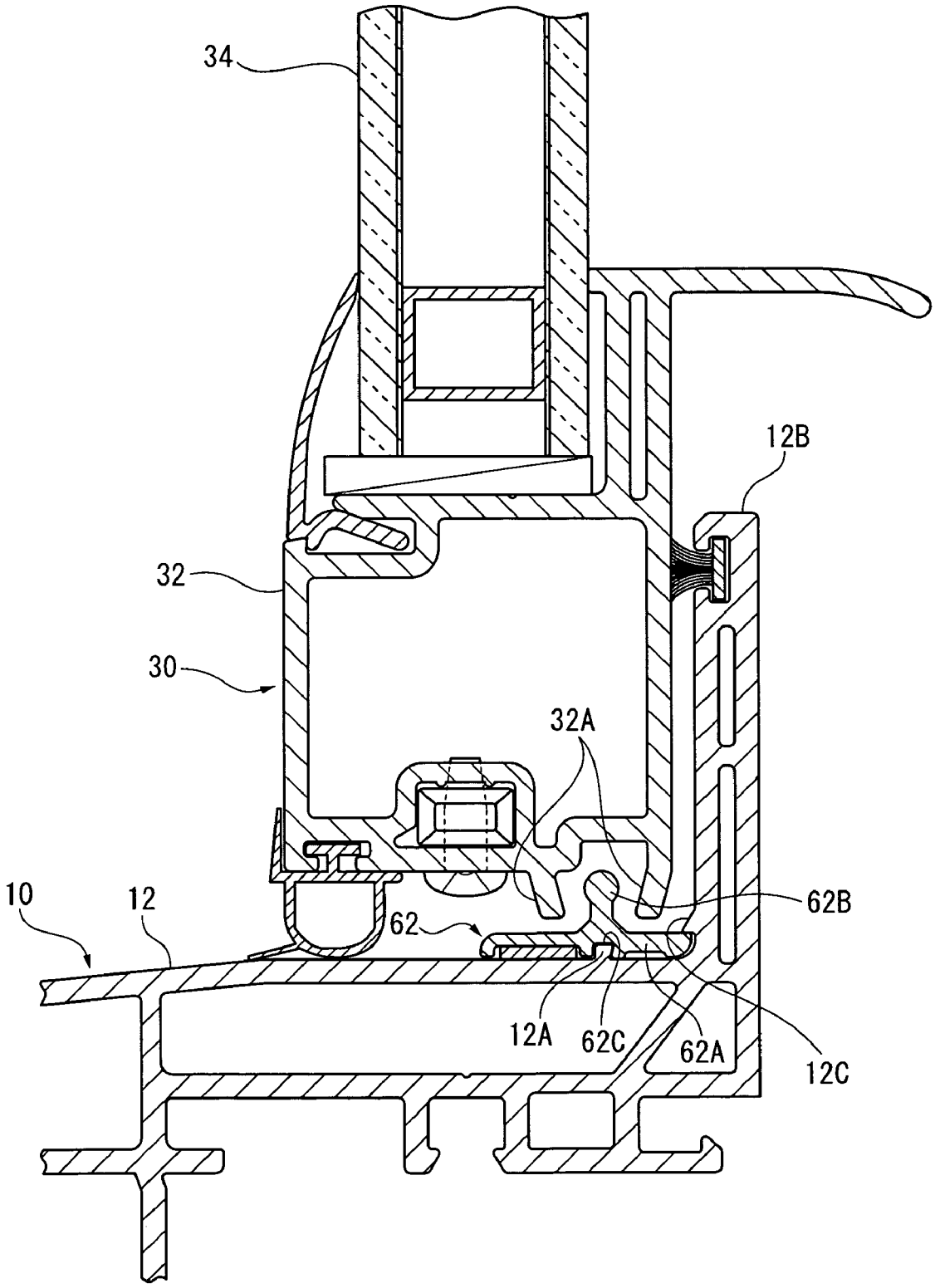
FIG. 16 is a cross-sectional view showing the displacement prevention member as it is installed in the sash window.

As shown in FIG. 16, the displacement prevention member 62 is fixed to the upper surface of the sill member 12 by means of screws (not shown) extending through the base portion 62A and threaded into the sill member 12, or a pressure-sensitive adhesive double-coated tape disposed between the rear surface of the base portion 62A and the upper surface of the sill member 12. In an attached or installed condition of the displacement prevention member 62, the protruding portion 62B is received between a pair of ribs 32A formed on a bottom surface of the bottom rail 32 of the lower sash 30 when the lower sash 30 is in the fully closed position. In this condition, the displacement prevention member 62 is able to prevent displacement of the lower sash 30 in the depth direction of the window and also is able to achieve a seal function as the protruding portion 62B is nested in a space defined between the ribs 32A. To ensure reliable positioning of the displacement prevention member 62 relative to the sill member 12, the sill member 12 has on its upper surface a longitudinal ridge or rib 12A, which forms the other part of the ridge-and-groove fitting structure. As previously described, the groove 62C is formed in the rear surface of the displacement prevention member 62 and the rib 12A is formed on the upper surface of the sill member 12. When the displacement prevention member 62 is to be fixed on the sill member 12, the groove 62C is fitted with the rib 12A. This facilitates easy positioning of the displacement prevention member 62 relative to the sill member 12.

The ridge-and-groove fitting structure formed by the groove 62C and the rib 12 fitted with each other is also able to perform a load transmitting function for reliable transmission of an external force applied to the lower sash 30 in the depth direction to the sill member 12. For instance, when the lower sash 30 is subjected to external force acting in the depth direction of the window during a storm, the lower sash 30 tends to displace in the depth direction. In this instance, however, since the ribs 32A of the lower sash 30 being displaced come into engagement with the protruding portion 62B of the displacement prevention member 62 the displacement prevention member 62 prevents further displacement of the lower sash 30 in the depth direction. As the external force becomes large, a load transmitted via the rib 32A and the protruding portion 62B to the displacement prevention member 62 increases. In this instance, however, since the ridge-and-grove fitting structure formed jointly by the rib 12A and the groove 62C fitted together is able to achieve the aforesaid load-transmitting function, the displacement prevention member 62 can withstand such great external force without causing displacement relative to the sill member 12.

To achieve the positioning function satisfactorily, the fitting engagement between the groove 62C and the rib 12A should preferably involve a relatively small play. On the other hand, engagement between the ribs 32A on the lower sash 30 and the protruding portion 62B of the displacement prevention member 62 is allowed to involve a relatively large play because it engages in auxiliary load transmission only when the lower sash 30 is displaced to a certain extent under the effect of the external load. The protruding portion 62A of the displacement prevention member 62 should not be limited to a continuous rib-like configuration but may take the form of a series of discrete protrusions arranged in a longitudinal direction of the base portion 62A.

The sill member 12 has an upwardly projecting flange 12B on the interior side thereof, and a locking projection 12C formed on a lower end portion of an exterior surface of the flange 12B and extending continuously along the length of the flange 12B. The locking projection 12C is arranged such that when the displacement prevention member 62 is placed in a predetermined position determined by the groove 62C and the rib 12A fitted together for attachment of the displacement prevention member 62 to the sill member 12, the locking projection 12C on the flange 12B comes into interlocking engagement with an inside longitudinal edge of the base member 62A to keep the latter in position against floating or upward movement relative to the sill member 12.

The locking projection 12C is not essential to the invention and hence can be omitted as appropriate. The displacement prevention member 62 should not be limited to the one shown in the illustrated embodiment but may include such a displacement prevention member which is secured to a bottom surface of the lower sash 30 and engageable in a recessed portion or groove formed in the sill member 12.

Figure 17:
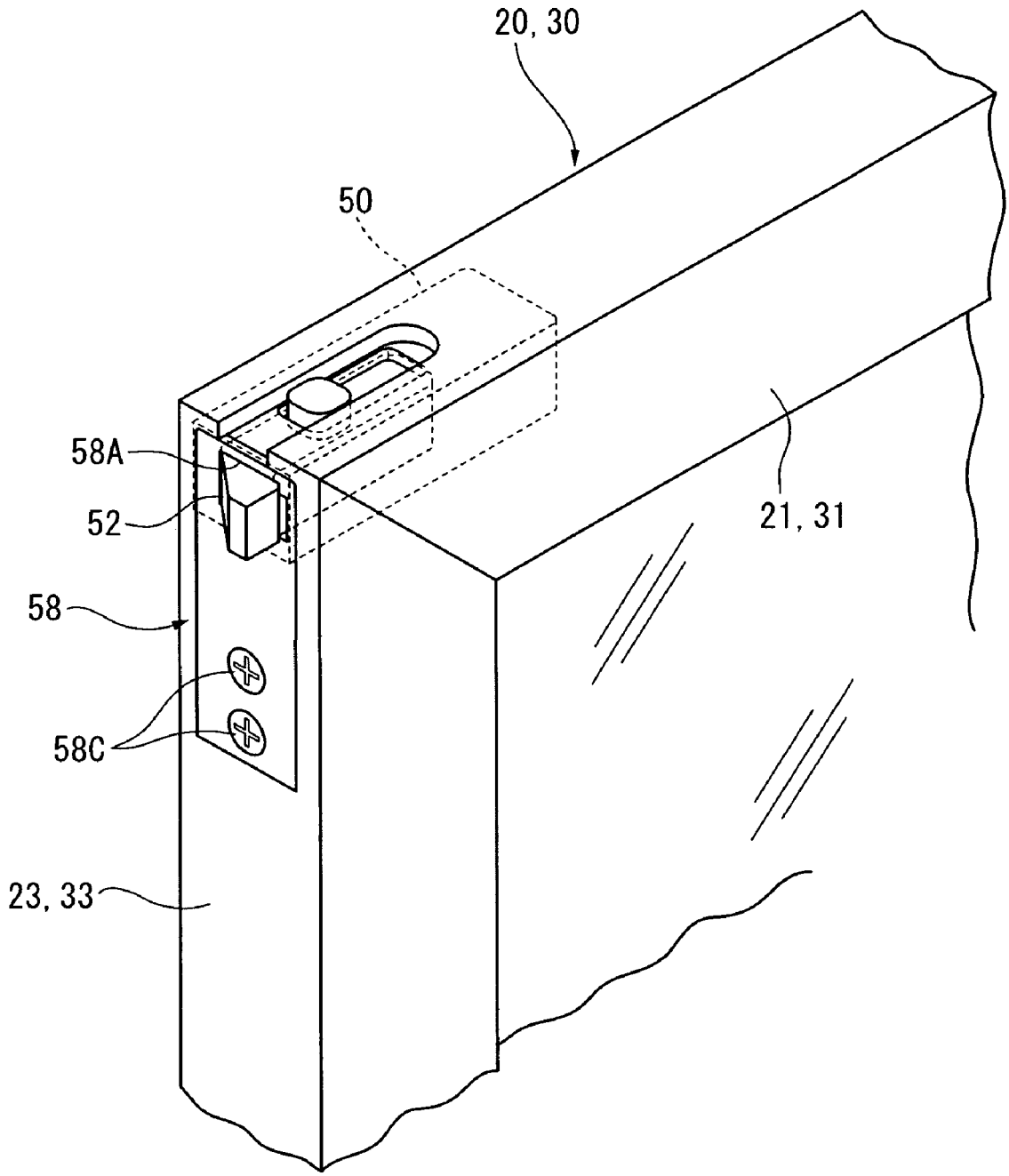
FIG. 17 is a perspective view showing a latch cover installed in the sash window.

As shown in FIG. 17, the latch device 50 is incorporated in an upper end portion of the upper sash 20 or the lower sash 30 at opposite sides of each sash. Each sash 20, 30 has a latch cover 58 attached thereto so as to cover that portion of the sash in which the latch device 50 is installed.

Figure 18:
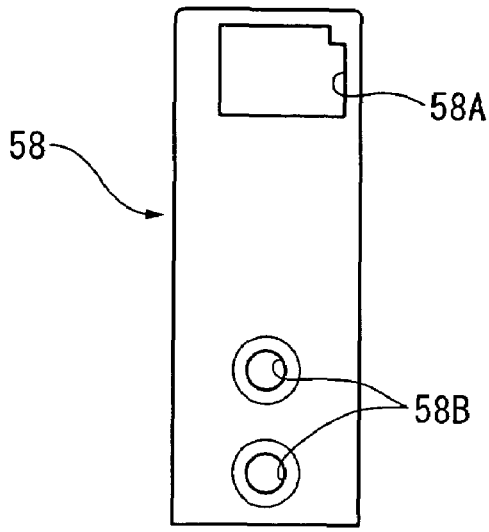
FIG. 18 is a front elevational view of the latch cover.
Figure 19:
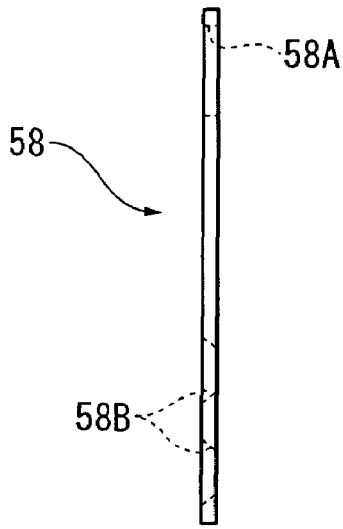
FIG. 19 is a side view of the latch cover.

As shown in FIGS. 18 and 19, the latch cover 58 is formed from a rigid plate of metal or reinforced plastic into a rectangular configuration and has a generally rectangular opening 58A formed in one end portion thereof, and a plurality (two in the illustrated embodiment) of attachment holes 58B formed in an opposite end portion thereof The opening 58A has a shape complementary in contour to the shape (cross-sectional shape) of the latch bolt 52 (FIG. 17) and has a size larger by several millimeters for each side than a size of the contour of the latch bolt 52. The opening 58A allows passage of the latch bolt 52 without interference and is engageable at an inner peripheral surface or edge thereof with an outer peripheral surface of the latch bolt 52 when the latch bolt 52 is displaced in any direction other than a direction parallel to an axis of the latch bolt 52.

The attachment holes 58B accept passage of respective shanks of two screws 58C (FIG. 17) when the latch cover 58 is attached or screwed to each side rail 23, 33 of the upper sash 20 or the lower sash 30. The side rail 23, 33 preferably has a recessed portion (not designated) formed therein with a depth substantially equal to a thickness of the latch cover 58 so that the latch cover 58 is accommodated within the recessed portion with its outer surface lying flush with an outer surface of the side rail 23, 33.

With the latch cover 58 thus arranged, when the latch bolt 52 of the latch device 50 is subjected to a load or force acting in the depth direction of the window under the effect of an external force applied to the upper and lower sashes 20, 30, the inner peripheral edge of the opening 58A supports or bears the latch bolt 52 to thereby maintain a necessary strength of the latch bolt 52. In this instance, since the inner peripheral edge of the opening 58A and an outer peripheral surface of the latch bolt 52 are not always held in close contact with each other, the latch device 50 can be manually operated smoothly. On the other hand, when the upper and lower sashes 20, 30 are displaced by an external force in the depth direction, the inner peripheral edge of the opening 58A comes into abutment with the outer peripheral surface of the latch bolt 52 to thereby assist supporting of the latch bolt 52.

In the illustrated embodiment, each of the parts or members of the sash window can achieve an advantageous effect or effects in the manner as described above. Since the individual parts or members are assembled together to form a single sash window, it is possible to further improve the overall strength of the sash window.

The present invention should not be limited to the embodiment described above. Rather, various changes and modifications are possible for each structural part of the present invention. Furthermore, it is not essential for each structural part to have all of the reinforcements described above and it is possible to omit parts of the reinforcements.

The cover member 61, displacement prevention member 62, reinforcement members 29, 39, 59 and holder member 49 may be incorporated in other window frames than the window frame 10 in the illustrated embodiment. For instance, these members can be also effectively applied to horizontal sliding windows, fixed windows or the like.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A sash window comprising:

a window frame including a head member, a sill member and a pair of jamb members connected together into a rectangular configuration; and at least one sash having a sash frame including a top rail, a bottom rail and a pair of side rails connected together into a rectangular configuration, and a panel member disposed within the sash frame, said at least one sash being supported within the window frame and slidably movable along the jamb members between a fully closed position and a fully open position, wherein each of said side rails comprises: (1) a support device disposed on a lower end portion thereof, said support device comprising a slide shoe and a pivot shaft, the slide shoe being slidably disposed in a vertical track defined by each of said jamb members, and said pivot shaft extending between an edge of said side rail and said slide shoe, said pivot shaft pivotally supporting said at least one sash relative to the window frame, and (2) a latch device disposed on an upper end portion of said at least one sash and releasably engageable with each of the jamb members to lock said at least one sash in position against pivotal movement relative to the window frame, and wherein said sash window further comprises a pair of holder members disposed adjacent a lower end portion of each of said jamb members, each of said holder members comprising an attachment portion attached to said sill member and a protruding portion extending upwardly from said attachment portion and disposed adjacent said lower end portion of each of said jamb members, said protruding portion defining a slit that extends from an upper edge thereof, said slit receiving the pivot shaft of the support device when said at least one sash is disposed in the fully closed position, and said protruding portion of said holder member preventing movement of said slide shoe in a direction toward a center longitudinal axis of said sash window, said center longitudinal axis of said sash window being substantially parallel to said jamb members.

2. The sash window according to claim 1, wherein said holder member is made of metal.

3. The sash window according to claim 1, wherein said vertical track of each of said jamb members has a portion engaging with a latch bolt of the latch device when said at least one sash is in the fully closed position, and a first reinforcement member is disposed within said vertical track of said jamb member adjacent said jamb member portion and reinforces said jamb member portion.

4. The sash window according to claim 3, wherein said jamb members are formed from synthetic resin material and said first reinforcement member is made of metal.

5. The sash window according to claim 3, wherein said at least one sash includes a second reinforcement member disposed in at least one of the top rail, bottom rail and each side rail.

6. The sash window according to claim 5, wherein said second reinforcement member is disposed in at least the top rail of said at least one sash and extends over the entire length of the top rail.

7. The sash window according to claim 5, wherein said second reinforcement member comprises (1) a metal member having a hollow cross-sectional shape and extending over the entire length of said at least one rail, (2) a filler filled in at least one of an internal space of the hollow metal member and a space defined between the hollow metal member and said at least one rail.

8. The sash window according to claim 5, wherein:

said at least one sash comprises a lower sash and an upper sash, said second reinforcement member is disposed in said top rail of said lower sash, said top rail of said lower sash comprises a downwardly extending flange that extends alone an exterior surface of said top rail of said lower sash, said bottom rail of said upper sash comprises an upwardly extending flange that extends alone an interior surface of said bottom rail of said upper sash, at least one elongated fastener member extends through said downwardly extending flange, said bottom rail, and the second reinforcement member and said upwardly extending flange defines at least one slit that extends downwardly from an upper edge of the upwardly extending flange, wherein when said upper sash and said lower sash are in a fully closed position, said upwardly extending flange and said downwardly extending flange engage in a labyrinth seal and said portion of said fastener member is engaged in said slit of said upwardly extending flange.

9. The sash window according to claim 1, wherein said window frame has a slit formed in at least one of the head member, sill member and each jamb member, and a cover member mounted to cover the slit of the frame, said cover member including a base portion fitted with the slit of the frame, a protruding portion integral with and projecting from the base portion and extending continuously in a longitudinal direction of the base portion, and a seal member mounted on the protruding portion and sealingly engageable with a mating one of the rails of said at least one sash.

10. The sash window according to claim 1, wherein said at least one sash is a lower sash and said window frame farther includes a displacement prevention member having a base portion attached to the sill member and a protruding portion integral with and projecting upwardly from the base portion, the displacement prevention member extending along an upper surface of the sill member, said protruding portion being engageable with at least a portion of a lower surface of the bottom rail of the lower sash to prevent movement of the bottom rail in at least one of an inward direction and an outward direction of the sash window when the lower sash is in the fully closed position.

11. The sash window according to claim 1, wherein said upper end portion of each of said side rails includes a latch cover mounted thereon, the latch cover defining an opening through which a latch bolt of the latch device extends and engages the respective jamb member adjacent the side rail, said opening being smaller than an adjacent opening in the side rail through which the latch bolt extends.

12. The sash window according to claim 1:

wherein a vertical track of each of said jamb members has a portion adapted for engagement with a latch bolt of the latch device when said at least one sash is in the fully closed position, and a first reinforcement member is disposed within said vertical track of each jamb member adjacent the jamb member portion and indirectly reinforces said jamb member portion from inside the jamb member such that the latch bolt directly engages an outer surface of the jamb member portion and the first reinforcement member engages a inner surface of the jamb member portion, the inner surface being opposite and spaced apart from the outer surface.

13. The sash window according to claim 12, wherein said jamb members are formed from synthetic resin material and said first reinforcement member is made of metal.

14. The sash window according to claim 12, wherein said at least one sash includes a second reinforcement member disposed in at least one of the top rail, bottom rail and each side rail.

15. The sash window according to claim 14, wherein said second reinforcement member is disposed in at least the top rail of said at least one sash and extends over the entire length of the top rail.

16. The sash window according to claim 14, wherein said second reinforcement member comprises: (1) a metal member having a hollow cross-sectional shape and extending over the entire length of said at least one rail and (2) a filler filled in at least one of an internal space of the hollow metal member and a space defined between the hollow metal member and said at least one rail.

17. The sash window according to claim 14, wherein:

said at least one sash comprises a lower sash and an upper sash, said second reinforcement member is disposed in said top rail of said lower sash, said top rail of said lower sash comprises a downwardly extending flange that extends alone an exterior surface of said top rail of said lower sash, said bottom rail of said upper sash comprises an upwardly extending flange that extends alone an interior surface of said bottom rail of said upper sash, at least one elongated fastener member extends through said downwardly extending flange, said bottom rail, and the second reinforcement member and said upwardly extending flange defines at least one slit that extends downwardly from an upper edge of the upwardly extending flange, wherein when said upper sash and said lower sash are in a fully closed position, said upwardly extending flange and said downwardly extending flange engage in a labyrinth seal and said portion of said fastener member is engaged in said slit of said upwardly extending flange.

18. The sash window according to claim 12, wherein said window frame has a slit formed in at least one of the head member, sill member and each jamb member, and a cover member mounted to cover the slit, said cover member including a base portion fitted with the slit, a protruding portion integral with and projecting from the base portion and extending continuously in a longitudinal direction of the base portion, and a seal member mounted on the protruding portion and sealingly engageable with a mating one of the rails of said at least one sash.

19. The sash window according to claim 12, wherein said at least one sash is a lower sash and said window frame farther includes a displacement prevention member having a base portion attached to the sill member and a protruding portion integral with and projecting upwardly from the base portion, the displacement prevention member extending along an upper surface of the sill member, said protruding portion being engageable with at least a portion of a lower surface of the bottom rail of the lower sash to prevent movement of the bottom rail in at least one of an inward direction and an outward direction of the sash window when the lower sash is in the fully closed position.

20. The sash window according to claim 12, wherein said upper end portion of each of said side rails includes a latch cover mounted thereon, the latch cover defining an opening through which a latch bolt of the latch device extends and engages the respective jamb member adjacent the side rail, said opening being smaller than an adjacent opening in the side rail through which the latch bolt extends.

21. The sash window according to claim 1 wherein:

said at least on sash comprises a lower sash and an upper sash, each of said sashes having a sash frame including a top rail, a bottom rail and a pair of side rails connected together into a rectangular configuration, and a panel member disposed within the sash frame, said sashes being supported within the window frame and slidably movable along the jamb members between a fully closed position and a fully open position, wherein:

said lower sash includes a reinforcement member disposed in the top rail thereof, said top rail of said lower sash comprises a downwardly extending flange that extends along an exterior surface of said top rail of said lower sash, said bottom rail of said upper sash comprises an upwardly extending flange that extends along an interior surface of said bottom rail of said upper sash, at least one elongated fastener member extends through said downwardly extending flange, said top rail of said lower sash, and the reinforcement member, and said upwardly extending flange defines at least one slit that extends downwardly from an upper edge of the upwardly extending flange, wherein when said upper sash and said lower sash are in a fully closed position, said upwardly extending flange and said downwardly extending flange engage in a labyrinth seal and said portion of said fastener member is engaged in said slit of said upwardly extending flange, whereby the at least one fastener transfers a force on the downwardly extending flange to the reinforcement member extending through the top rail of the lower sash.

22. The sash window according to claim 21, wherein said reinforcement member extends over the entire length of the top rail.

23. The sash window according to claim 21, wherein said reinforcement member comprises a metal member having a hollow cross-sectional shape and extends over the entire length of said top rail, and a filler filled in at least one of an internal space of the hollow metal member and a space defined between the hollow metal member and said top rail.

24. The sash window according to claim 21, wherein said window frame has a slit formed in at least one of the head member, sill member and each jamb member, and a cover member mounted to cover the slit, said cover member including a base portion fitted with the slit, a protruding portion integral with and projecting from the base portion and extending continuously in a longitudinal direction of the base portion, and a seal member mounted on the protruding portion and sealingly engageable with a mating one of the rails of said at least one sash.

25. The sash window according to claim 21, wherein said window frame farther includes a displacement prevention member having a base portion attached to the sill member and a protruding portion integral with and projecting upwardly from the base portion, and the displacement prevention member extending, said protruding portion being engageable with at least a portion of a lower surface of the bottom rail of the lower sash to prevent movement of the bottom rail in at least one of an inward direction and an outward direction of the sash window when the lower sash is in the fully closed position.

26. The sash window according to claim 21, wherein said upper end portion of each of said side rails includes a latch cover mounted thereon, the latch cover defining an opening through which a latch bolt of the latch device extends and engages the respective jamb member adjacent the side rail, said opening being smaller than an adjacent opening in the side rail through which the latch bolt extends.

* * * * *

UNITED STATES PATENT AND TRADEMARK OFFICE

CERTIFICATE OF CORRECTION

PATENT NO. : 7,571,568 B2
APPLICATION NO. : 11/328572
DATED : August 11, 2009
INVENTOR(S) : Ito et al.

It is certified that error appears in the above-identified patent and that said Letters Patent is hereby corrected as shown below:

Column 14,
Line 34, after "rail," insert --and--;
Lines 44 and 47, "alone" should read --along--.

Column 15,
Line 4, "farther" should read --further--;
Lines 60 and 63, "alone" should read --along--.

Column 16,
Line 20, "farther" should read --further--.

Column 18,
Line 2, "farther" should read --further--.

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,571,568 B2
APPLICATION NO. : 11/328572
DATED : August 11, 2009
INVENTOR(S) : Ito et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 769 days.

Signed and Sealed this

Seventh Day of September, 2010

David J. Kappos

David J. Kappos
*Director of the United States Patent and Trademark Office*